United States Patent [19]

Steeves

[11] 4,041,563

[45] Aug. 16, 1977

[54] SCOURING SLEEVE FOR USE WITH SWIMMING POOL CLEANER

[76] Inventor: Claire L. Steeves, 1300 Mistletoe, Fort Worth, Tex. 76110

[21] Appl. No.: 670,640

[22] Filed: Mar. 26, 1976

[51] Int. Cl.[2] ..... E04H 3/20

[52] U.S. Cl. ..... 15/1.7; 134/167 R

[58] Field of Search ..... 15/1.7; 4/172.16; 134/166 R, 168 R, 167 R; 138/123-125

[56] References Cited

U.S. PATENT DOCUMENTS

| | | | |
|---|---|---|---|
| 2,009,075 | 7/1935 | Thompson | 138/125 X |
| 2,982,971 | 5/1961 | Garaway | 15/1.7 X |
| 3,251,381 | 5/1966 | Koch | 138/125 |
| 3,794,052 | 2/1974 | Koble, Jr. et al. | 15/1.7 X |

*Primary Examiner*—Edward L. Roberts
*Attorney, Agent, or Firm*—Wofford, Felsman, Fails & Zobal

[57] ABSTRACT

A scouring sleeve for use with a swimming pool cleaner. The swimming pool cleaner includes a flexible hose connected to a high pressure water supply. The hose has an outlet for discharging a high pressure jet to dislodge sediment from the pool walls and floor. It constantly repositions itself due to the reaction of the jet. A reticulated sleeve covers the portions of the hose in contact with the floor and walls, further scraping the sediment. The sleeve is of woven flexible plastic strips and is detachable from the hose for replacement when worn.

2 Claims, 7 Drawing Figures

Fig.3
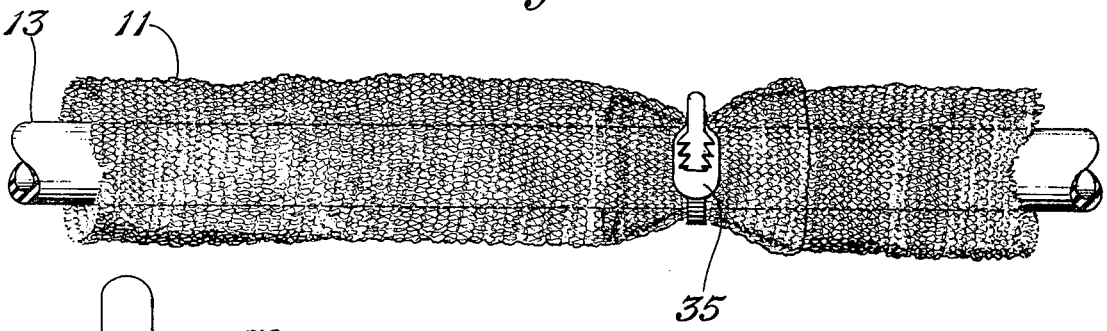
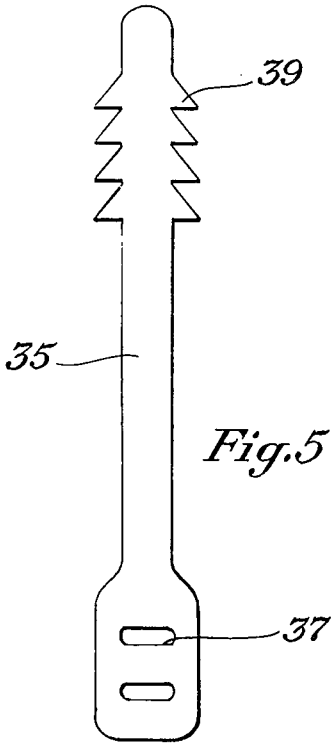
Fig.5
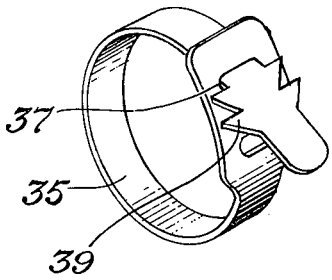
Fig.6
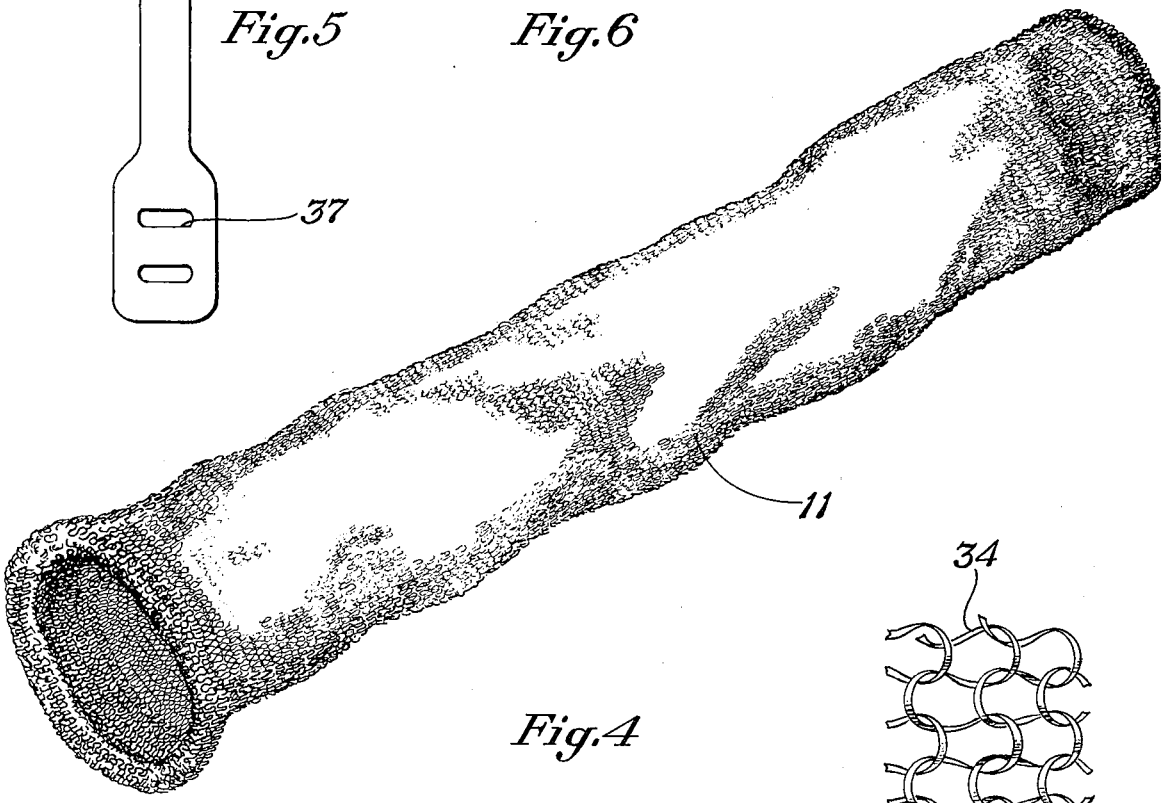
Fig.4
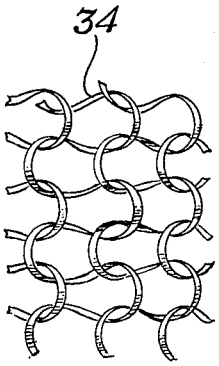
Fig.7

SCOURING SLEEVE FOR USE WITH SWIMMING POOL CLEANER

BACKGROUND OF THE INVENTION

1. Field of the Invention:

This invention relates in general to a swimming pool cleaning apparatus and in particular to a scouring sleeve for use on a swimming pool cleaner hose for dislodging sediment.

2. Description of the Prior Art:

Swimming pools develop sediment, silt and residue on the walls and floor. There are several methods in use for removing the sediment. One such method is to connect a flexible hose to the pool circulation system and allow the hose to submerge in the pool. High pressure water discharged from the hose outlet dislodges sediment, which is then removed by the pool circulation system and filter. The reaction of the jet spray causes the hose to constantly reposition itself. To take advantage of the writhing motion of the hose for cleaning purposes, the device disclosed in U.S. Pat. No. 2,982,971 issued to Garaway, discloses a hose having bristles wound helically up the hose. The bristles scrape the sediment as the hose moves to provide additional cleaning action.

One disadvantage with the helical bristles arrangement is that it does not appear to be easily installed on an existing conventional hose, nor readily removable should the bristles become worn. Also because of the spaces between the flights of the helical bristle arrangement, portions of the floor between the flights may not be contacted by the bristles.

SUMMARY OF THE INVENTION

It is a general object of this invention to provide an improved scouring means for use with a swimming pool cleaner hose.

It is a further object of this invention to provide an improved scouring means that is easily attached and removed from conventional flexible hoses for cleaning swimming pools.

It is a further object of this invention to provide an improved scouring means that scrapes substantially all of the pool surface that is beneath the hose.

In accordance with these objects, an elongated reticulated sleeve is provided for insertion over the hose. The sleeve is of coarsely woven thin plastic strips, the edges and sides of the strips providing a scouring action. The sleeve is of a length to cover substantially all of the portions of the hose that will be in contact with the pool wall and floor surfaces. The sleeve is held in place by plastic bands that have wedge shaped tabs and slots to restrain the bands tightly against the sleeve.

BRIEF DESCRIPTION OF THE DRAWINGS

FIG. 3 is an enlarged partial side elevational view of the scouring sleeve and hose of FIG. 1.

FIG. 4 is a partial perspective view of the scouring sleeve of FIG. 1, shown detached from the hose.

FIG. 5 is a side elevational view of the fastener shown in FIG. 3.

FIG. 6 is a perspective view of the fastener shown in FIG. 3.

FIG. 7 is an enlarged partial elevational view of the scouring sleeve in FIG. 4.

DESCRIPTION OF THE PREFERRED EMBODIMENT

Figure 1:
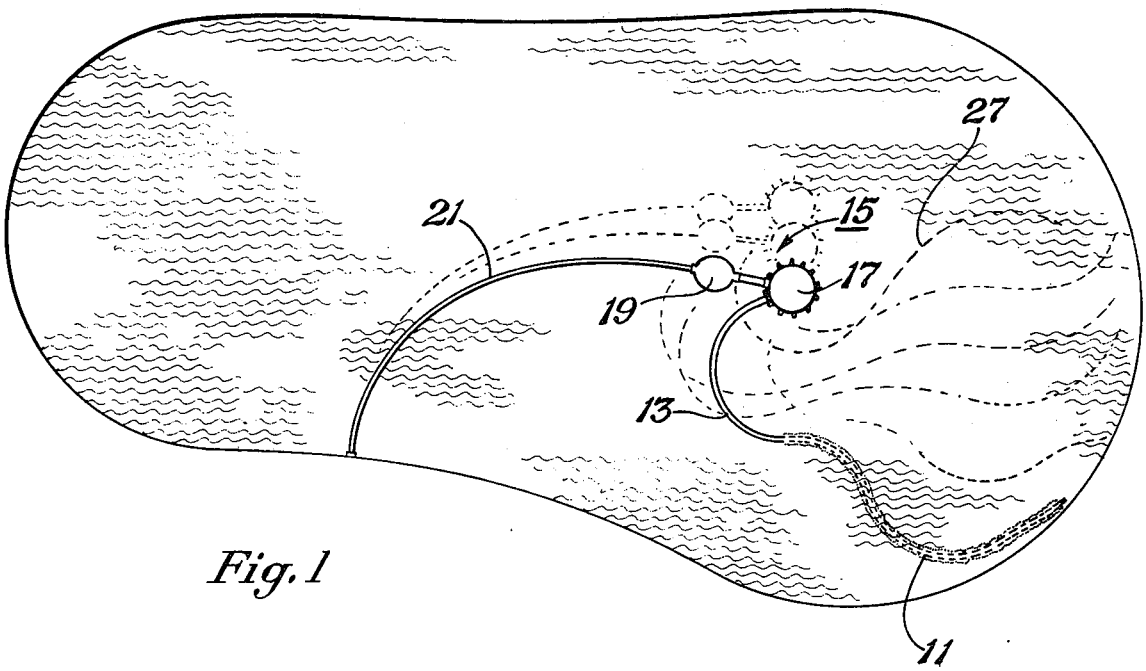
FIG. 1 is a top plan view of the scouring sleeve of this invention attached to a swimming pool cleaner hose in a swimming pool.

FIG. 1 illustrates a scouring sleeve 11 attached to a swimming pool cleaner hose 13. Swimming pool cleaner hose 13 is attached to an automatic swimming pool cleaner 15 comprising a floating body 17 buoyed by an adjacent float 19 and connected to an inlet hose 21. The inlet hose 21 is connected to a high pressure water supply such as the pool circulation system. Floating body 17, shown more clearly in FIG. 2, contains a reaction wheel 23 and jets (not shown), for propelling itself around the sides of the pool. As it self-propels itself about the sides of the pool, the floating body 17 drags the cleaner hose 13 so that substantially full coverage of the pool is achieved. Cleaner hose 13 has an outlet or nozzle 25 for discharging a high pressure stream of water to dislodge sediment. The reaction from the jet spray causes the hose to constantly reposition itself in a writhing and sinuous fashion, as shown by the phantom lines 27 in FIG. 1. Various automatic swimming pool cleaners 15 are known in the art. Many have outlets for two cleaners hoses. Moreover the scouring sleeve will function as well with a hose simply connected to the circulation system, and not to a floating body 17, however coverage of the pool is not as great.

Figure 2:
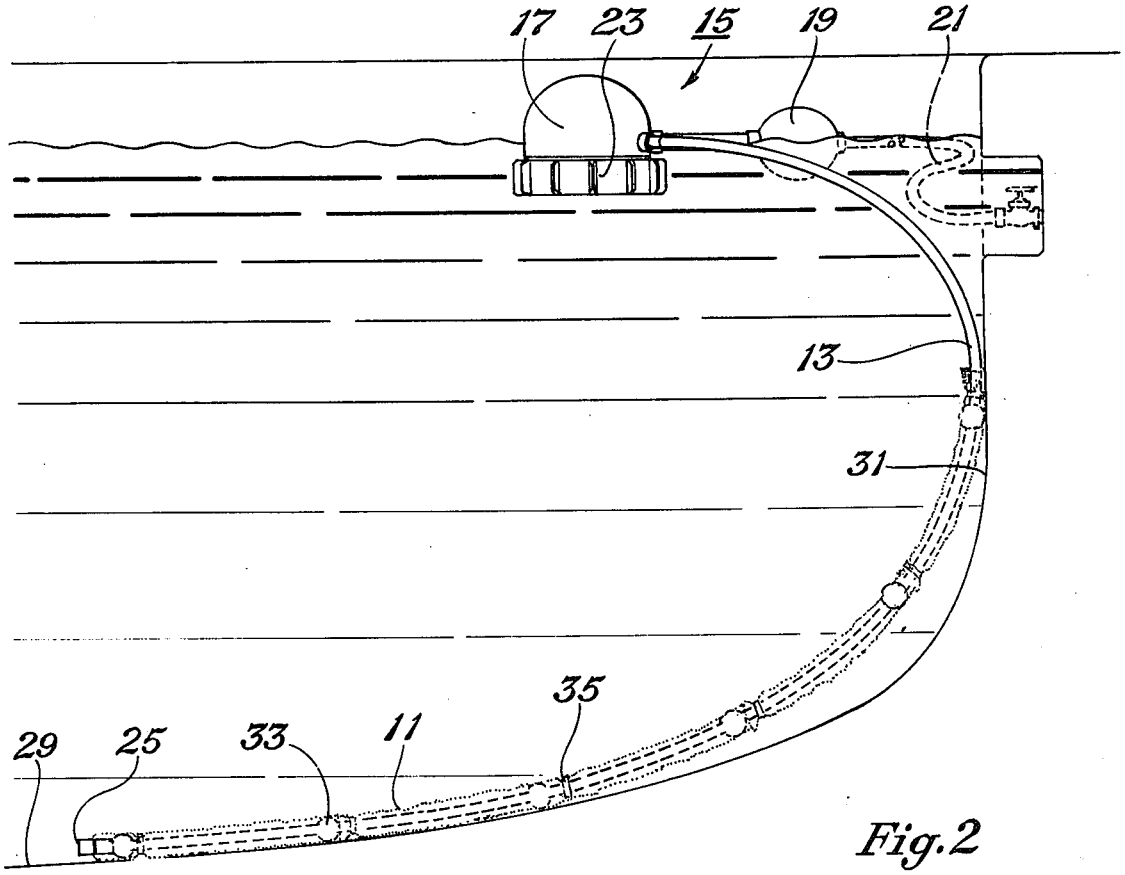
FIG. 2 is an enlarged side elevational view of the scouring sleeve in accordance with this invention, attached to a swimming pool cleaner hose.

Referring to FIG. 2, while in operation a substantial portion of the hose will be lying on the floor 29. If it is desired to clean the walls 31 of the swimming pool, a shorter hose length is normally used, or both may be used simultaneously. Conventional swimming pool cleaner hoses 13 normally have a series of plastic bumpers 33 to prevent the abrasive surface of the pool from wearing the hose surface. Scouring sleeve 11 may be used either with the plastic bumpers in place, with a portion removed, or with all of them removed.

Referring to FIG. 3, the scouring sleeve 11 is an elongated sleeve of a length selected to cover substantially all of the portions of the hose that will be in contact with the pool floor 29 or walls 31. Normally this is at least four feet, and preferably 6 feet. The diameter of the sleeve is preferably 3 inches, sufficient for the hose 13 and bumpers 33 to be easily inserted through. As shown in FIG. 7, the sleeve is reticulated, or a mesh of coarsely woven, thin, flat plastic strips 34, that are flexible and approximately 1/32 inches in width. The strips 34 cross and loop through each other in a knitting stitch. The space between the plastic strips 34 in the weave, or the width of the loops at the widest point, is approximately 1/8 inches. The same type of plastic woven material is marketed in the form of a ball or pad for kitchen uses under the trademark TUFFY, manufactured by Miles Laboratories, Grocery Products Div., Chicago, Ill. 60638. One sleeve of full length may be used, or a plurality of sleeves, each overlapping each other, may be used, as shown in FIG. 3.

As shown in FIGS. 2 and 3, the sleeve is restrained to the hose at several points by fastener means, or plastic bands 35. Plastic bands 35 are the type used to fasten plastic refuse sacks. Each has means to restrain the band tightly over the sleeve, including at least one slot 37 on one end, and a plurality of wedge shaped tabs 39 on the other end. As shown in FIGS. 3 and 6, band 35 is drawn around the sleeve 11 with the tabs 39 inserted through slot 37 until tight.

In operation, the sleeve 11 is inserted over the outlet hose 13, with one end of the sleeve being aligned with the nozzle 25. If the length of the sleeve is insufficient to cover all portions of the hose that will be in contact with the floor, another sleeve may be drawn over and overlapped, as shown in FIG. 3. At least two plastic bands 35 are fastened over the sleeve, one adjacent the nozzle, and one adjacent the other end. The outlet hose 13 is connected to floating body 17, or directly to the pool circulation system. The hose is allowed to submerge in the water, and high pressure water supplied. The jet spray dislodges sediment and residue, and the hose constantly repositions itself due to the reaction force. The repositioning of the hose causes the sediment to remain in suspension in the water until it can be drawn out through the pool filter by the circulation system. The scouring action of the sleeve 11 further stirs up and scrapes the bottom, cleaning the pool. The side edges of the strips in the sleeve provide desired scraping action.

It is accordingly seen that an invention having significant improvements has been provided. The reticulated sleeve effectively scrapes and scours the pool surface as the swimming pool cleaner hose repositions itself. The sleeve is inexpensive to manufacture and is easily attached and removed from conventional pool cleaner hoses. Substantially all of the surface beneath the reticulated sleeve will be in contact with the sleeve, providing full coverage.

The foregoing disclosure and the showings made in the drawings are merely illustrative of the principles of this invention and are not to be interpreted in a limiting sense.

I claim:

1. For use with an apparatus for cleaning sediment deposited on the floor of a swimming pool of the type having a flexible hose having an inlet connected to the swimming pool circulation system and an outlet for discharging water to loosen sediment and to cause the hose to constantly reposition itself, an improved scouring means comprising:

a reticulated sleeve of coarsely woven flexible plastic strips for covering portions of the hose for scouring the floor and walls of the swimming pool as the hose repositions itself; and fastener means for retaining the sleeve over the hose comprising a band of plastic encircling the sleeve having means to restrain the band tightly over the sleeve.

2. An apparatus for cleaning sediment deposited on the floor and walls of a swimming pool comprising:

a flexible hose having an inlet connected to the swimming pool circulation system and an outlet for discharging water to loosen sediment, the hose being of sufficient length and flexibility so that the reaction of the discharging water causes it to constantly reposition itself;

a removable reticulated sleeve covering the hose substantially over the portions of the hose that contact the floor and walls of the swimming pool, for scouring the floor and walls of the swimming pool as the hose repositions itself; the sleeve being comprised of a plurality of flexible strips that cross and loop through each other, with the loops at the widest point being substantially greater in width than the width of the strips; and fastener means for retaining the sleeve over the hose.

* * * * *